US006683042B1

(12) United States Patent
Larson et al.

(10) Patent No.: US 6,683,042 B1
(45) **Date of Patent: *Jan. 27, 2004**

(54) GRANULATION METHOD

(75) Inventors: Bernd Larson, Erkelenz (DE); Wilfried Raehse, Duesseldorf (DE); Markus Semrau, Timmaspe (DE); Matthias Sunder, Duesseldorf (DE)

(73) Assignee: Henkel Kommanditgesellschaft auf Aktien (Henkel KGaA), Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/806,339

(22) PCT Filed: Sep. 18, 1999

(86) PCT No.: PCT/EP99/06917

§ 371 (c)(1),
(2), (4) Date: Mar. 29, 2001

(87) PCT Pub. No.: WO00/18871

PCT Pub. Date: Apr. 6, 2000

(30) Foreign Application Priority Data

Sep. 29, 1998 (DE) ..... 198 44 522

(51) Int. Cl.[7] ..... C11D 11/00

(52) U.S. Cl. ..... 510/444; 510/351; 510/353; 510/356; 510/357; 510/495; 510/535

(58) Field of Search ..... 510/444, 351, 510/353, 357, 356, 492, 535

(56) References Cited

U.S. PATENT DOCUMENTS

| | | | | |
|---|---|---|---|---|
| 3,234,258 A | | 2/1966 | Morris | 260/460 |
| 4,820,439 A | | 4/1989 | Rieck | 252/135 |
| 4,919,847 A | * | 4/1990 | Barletta et al. | 510/442 |
| 5,075,041 A | | 12/1991 | Lutz | 252/548 |
| 5,189,207 A | | 2/1993 | Blasey et al. | 562/97 |
| 5,356,607 A | | 10/1994 | Just | 423/334 |
| 5,399,287 A | | 3/1995 | Pichlet et al. | 252/174.24 |
| 5,616,550 A | | 4/1997 | Kruse et al. | 510/444 |
| 5,739,097 A | | 4/1998 | Bauer et al. | 510/446 |
| 5,780,420 A | | 7/1998 | Breuer et al. | 510/466 |

FOREIGN PATENT DOCUMENTS

| | | |
|---|---|---|
| DE | 3914131 | 10/1990 |
| DE | 44 00 024 | 1/1994 |
| DE | 43 04 062 | 8/1994 |
| DE | 44 25 968 | 2/1996 |
| EP | 0 164 514 | 4/1985 |
| EP | 0 211 493 | 6/1986 |
| EP | 0 265 203 | 10/1987 |
| EP | 0 402 111 | 6/1990 |
| EP | 0 560 802 | 11/1991 |
| EP | 0 508 543 | 4/1992 |
| EP | 0 642 576 | 5/1993 |
| GB | 1 151 767 | 5/1969 |
| JP | 58-217598 | 12/1983 |
| WO | WO90/13533 | 11/1990 |
| WO | WO91/08171 | 6/1991 |
| WO | WO95/07331 | 3/1995 |
| WO | WO96/03488 | 2/1996 |
| ZA | 6702422 | * 10/1968 |

OTHER PUBLICATIONS

The Manufacture of Modern Detergent Powders, Hermann de Grottó Academic Publisher, Wassenaar, 1995, p. 102.

* cited by examiner

*Primary Examiner*—Lorna M. Douyon
(74) *Attorney, Agent, or Firm*—Stephen D. Harper; Glenn E. J. Murphy

(57) ABSTRACT

Disclosed is a novel granulation method, wherein a surface active foam obtained by foaming a flowable component that contains a surface active agent with a gaseous medium is used as granulation adjuvant. The surface active foam has an average pore size of less than 10 mm.

82 Claims, No Drawings

GRANULATION METHOD

CROSS-REFERENCE TO RELATED APPLICATIONS

This application is a U.S. National Stage application filed under 35 U.S.C. §371, claiming priority of International Application No. PCT/EP99/06917, filed Sep. 18, 1999 in the European Patent Office, and DE 198 44 522.9, filed Sep. 39, 1998 in the German Patent Office, under 35 U.S.C. §§119 and 365.

FIELD OF THE INVENTION

The present invention relates to a process for preparing surfactant granules. It relates in particular to a process which permits the preparation of surfactant granules or surfactant components of laundry detergent and cleaning product compositions, or complete laundry detergent and cleaning product compositions, without spray drying steps or with reduced use of such steps.

BACKGROUND OF THE INVENTION

Granular laundry detergent and cleaning product compositions or components thereof are to a large extent prepared by spray drying. In the course of spray drying, the ingredients such as surfactants, builders etc. are mixed with from about 35 to 50% by weight of water to form an aqueous suspension, known as the slurry, and this slurry is atomized in spraying towers in a stream of hot gas to form the laundry detergent and cleaning product particles. Both the plants for this process and the implementation of the process are costly, since the majority of the slurry water must be evaporated in order to obtain particles having residual water contents of around 5 to 10% by weight. Moreover, the granules prepared by spray drying, although usually of excellent solubility, have low bulk densities, leading to higher packaging volumes and also transport and storage capacities. The flowability of spray-dried granules, also, is not optimal owing to their irregular surface structure, which affects their visual appearance. Spray drying processes have a further series of disadvantages, so that there has been no lack of attempts to carry out the preparation of laundry detergents and cleaning products entirely without spray drying, or at least to minimize the fraction of spray drying products in the finished product.

For instance, W. Hermann de Groot, I. Adami, G. F. Moretti "*The Manufacture of Modern Detergent Powders*", Hermann de Groot Academic Publisher, Wassenaar, 1995, page 102 ff. describes various mixing and granulating processes for the preparation of laundry detergents and cleaning products. These processes have the common feature that premixed solids are granulated with the addition of the liquid ingredients, and the granules are subjected, if desired, to subsequent drying.

In the patent literature as well there exists a broad prior art on the nontower preparation of laundry detergents and cleaning products. Numerous publications may be found in particular in relation to different apparatuses which are operated under varying conditions, to different granulating auxiliaries and their application to solids charged to a mixer, and to combinations of ingredients with physical conditions to be observed in the course of granulation.

For instance, the European patent EP 642 576 (Henkel) describes a two-stage granulation in two mixer/granulators positioned in series, 40–100% by weight, based on the overall amount of the constituents used, of the solid and liquid constituents being pregranulated in a first, low-speed granulator and the pregranulated product being mixed if appropriate with the remaining constituents and converted to granules in a second, high-speed granulator, observing the following process parameters: granulation in the first mixer at peripheral tool speeds of 2–7 m/s for 0.5–10 min, in the second mixer at peripheral speeds of 8–35 m/s for 0.1–30 (0.5–2)s; temperature of the pregranulated product on entry into the second granulating stage of 30–60° C.

In accordance with the teaching of European patent EP 560 802 (Henkel), zeolite granules comprising surfactant and with bulk densities of from 750 to 1000 g/l may be prepared by using as granulating fluid a mixture of water, surfactants and (co)polymeric carboxylates, the surfactant content of the granulating fluid being at least 10% by weight. In accordance with the teaching of this document, the granulating fluid is supplied through a spraying nozzle.

The European patent application EP-A-0 402 111 (Procter & Gamble) discloses a granulation process for preparing surfactant granules, in which surfactants, water and, optionally, fine powders are mixed to a paste which is granulated in a high-speed mixer by the addition of a "deagglomerating agent" (finely divided powder).

The European patent application EP-A-0 508 543 (Procter & Gamble) specifies a process in which a surfactant acid is neutralized with an excess of alkali to give a surfactant paste with a concentration of at least 40% by weight, which is subsequently conditioned and granulated, direct cooling taking place using dry ice or liquid nitrogen.

Surfactant mixtures which are subsequently applied to solid absorbents and provide laundry detergent compositions or components thereof are also described in EP 265 203 (Unilever). The liquid surfactant mixtures disclosed in this document comprise sodium salts or potassium salts of alkylbenzenesulfonic acids or alkylsulfuric acids in amounts of up to 80% by weight, ethoxylated nonionic surfactants in amounts of up to 80% by weight, and not more than 10% by weight of water.

Similar surfactant mixtures are also disclosed in the earlier EP 211 493 (Unilever). According to the teaching of this document, the surfactant mixtures for spray application contain between 40 and 92% by weight of a surfactant mixture and also more than 8 up to a maximum of 60% by weight of water. The surfactant mixture consists in turn of at least 50% of polyalkoxylated nonionic surfactants and ionic surfactants.

The European patent EP 772 674 (Henkel KGaA) describes a process for preparing surfactant granules by spray drying, in which anionic surfactant acid(s) and highly concentrated alkaline solutions are exposed separately to a gaseous medium and are mixed in a multifluid nozzle, neutralized and spray-dried by spraying into a stream of hot gas. The finely divided surfactant particles obtained in this way are subsequently agglomerated in a mixer to give granules having bulk densities above 400 g/l.

DESCRIPTION OF THE INVENTION

It is an object of the present invention to provide a process which permits the preparation of surfactant granules for laundry detergents and cleaning products without using spray drying steps or with reduced use of spray drying steps. The process to be provided should be suitable for universal use and with regard to the solids and granulating fluids that can be employed should be subject to as few restrictions as possible, while substantially avoiding the disadvantage of energy-consuming water evaporation.

These various objects are achieved in a mixing and granulating process in which a flowable component comprising surfactant is foamed by exposure to a gaseous medium to form a foam which acts as granulating auxiliary. The invention accordingly provides a process for preparing surfactant granules in which a flowable component comprising surfactant is exposed to a gaseous medium, the flowable component comprising surfactant being foamed by the gaseous medium, and the resulting surfactant foam subsequently being applied to a bed of solids charged to a mixer.

In comparison with the use of conventional granulating fluids, the process regime of the invention has considerable advantages. Through use of a "granulating foam" instead of conventional granulating fluids the distribution of liquid from the bed of solids is significantly more homogeneous. The particles of the bed of solids are wetted more effectively, and overall less granulating fluid is needed to form the granules, so that subsequent drying steps may be omitted. A further advantage is the more homogeneous particle size distribution of the resulting granules, since the use of the granulating foam prevents excessive agglomeration and the formation of lumps. Additionally, dust fractions and fine fractions are bound more effectively, so that the yields of granules in the desired particle size range (from about 400 to 1600 $\mu$m) are significantly improved in relation to conventional liquid granulations. In contrast to the conventional granulation with granulating fluids which have to be atomized or sprayed, the process of the invention also permits the use of significantly more viscous granulating fluids without technical problems. Details of this are set out later on below. The term "flowable" in the context of the present specification is applied to components which have a measurable viscosity, i.e., without external containers are not dimensionally stable and of firm consistency. Liquids which are "flowable" in the sense of the present specification, therefore, are in particular those having viscosities below 20 000 mPas.

The term "foam" used in the context of the present invention characterizes structures of gas-filled, spherical or polyhedral cells (pores) bounded by liquid, semiliquid or highly viscous cell walls.

If the volume concentration of the gas which forms the foam, with homodisperse distribution, is less than 74%, then the gas bubbles are spherical, owing to the surface-reducing effect of the interfacial tension. Above the limit of the closest spherical packing, the bubbles are deformed into polyhedral lamellae bounded by skins approximately 4–600 nm thick. The cell walls, connected by way of nodes, form a coherent framework. The foam lamellae (closed-cell foam) stretch between the cell walls. If the foam lamellae are destroyed or flow back into the cell walls at the end of foam formation, an open-cell foam is obtained. Foams are thermodynamically unstable since surface energy can be recovered by reducing the surface area. The stability and thus the resistance of the foams of the invention is therefore dependent on the extent to which it is possible to prevent their self-destruction.

In order to generate the foam, the gaseous medium is blown into the flowable component comprising surfactant, or foaming is brought about by intense beating, shaking, spray injection or stirring of the liquid in the gas atmosphere in question. Owing to the easier and more readily controllable and implementable foaming, distinct preference is given in the context of the present invention to foam generation by the blowing-in of the gaseous medium ("gassing") over the other variants. In accordance with a desired process variant, gassing takes place continuously or discontinuously by way of perforated plates, sinter disks, sieve inserts, Venturi nozzles or other customary systems.

As the gaseous medium for foaming it is possible to use any desired gases or gas mixtures. Examples of gases used in the art are nitrogen, oxygen, noble gases and noble-gas mixtures, such as helium, neon, argon and their mixtures, for example, carbon dioxide, etc. For reasons of cost, the process according to the invention is preferably conducted using air as the gaseous medium. If the components to be foamed are stable to oxidation, the gaseous medium may also consist in whole or in part of ozone, thereby making it possible to eliminate oxidatively destructible impurities or discolorations in the flowable components, comprising surfactant, that are to be foamed or to prevent microbial infestation of these components.

The process of the invention includes the independent component steps of the generation of foam from a flowable component comprising surfactant and the subsequent addition of the foam to a bed of solids moving in a mixer, where the foam acts as granulating auxiliary. The ingredients of the surfactant foam generated in the first component step are described below.

The flowable component comprising surfactant comprises surface-active substances from the group of the anionic, nonionic, zwitterionic or cationic surfactants, distinct preference being given to anionic surfactants on economic grounds and on account of their performance spectrum. The surfactant(s) content of the flowable component comprising surfactant may vary within wide limits. In accordance with the invention, preference is given to processes wherein the flowable component comprising surfactant comprises one or more surfactants from the group of the anionic and/or nonionic and/or cationic and/or amphoteric surfactants in amounts of from 20 to 100% by weight, preferably from 50 to 95% by weight, and in particular from 60 to 90% by weight, based in each case on the surfactant component. As mentioned above, preference is given to process variants of the invention wherein the flowable component comprising surfactant comprises anionic surfactant(s) in amounts of from 10 to 90% by weight, preferably from 20 to 85% by weight, and in particular from 30 to 80% by weight, based in each case on the surfactant component.

Anionic surfactants used are, for example, those of the sulfonate and sulfate type. Preferred surfactants of the sulfonate type are $C_{9-13}$ alkylbenzenesulfonates, olefinsulfonates, i.e., mixtures of alkenesulfonates and hydroxyalkanesulfonates, and also disulfonates, as are obtained, for example, from $C_{12-18}$ monoolefins having a terminal or internal double bond by sulfonating with gaseous sulfur trioxide followed by alkaline or acidic hydrolysis of the sulfonation products. Also suitable are alkanesulfonates, which are obtained from $C_{12-18}$ alkanes, for example, by sulfochlorination or sulfoxidation with subsequent hydrolysis or neutralization, respectively. Likewise suitable, in addition, are the esters of $\alpha$-sulfo fatty acids (ester sulfonates), e.g., the $\alpha$-sulfonated methyl esters of hydrogenated coconut, palm kernel or tallow fatty acids. In accordance with the invention, preference is given to processes wherein the flowable component comprising surfactant comprises alkali metal salts of alkylbenzenesulfonic acids in amounts of from 20 to 90% by weight, preferably from 30 to 85% by weight, and in particular from 40 to 80% by weight, based in each case on the surfactant component.

Further suitable anionic surfactants are sulfated fatty acid glycerol esters. Fatty acid glycerol esters are the monoesters, diesters and triesters, and mixtures thereof, as obtained in the preparation by esterification of a monoglycerol with from 1 to 3 mol of fatty acid or in the transesterification of triglycerides with from 0.3 to 2 mol of glycerol.

Preferred sulfated fatty acid glycerol esters are the sulfation products of saturated fatty acids having 6 to 22 carbon atoms, examples being those of caproic acid, caprylic acid, capric acid, myristic acid, lauric acid, palmitic acid, stearic acid, or behenic acid.

Preferred alk(en)yl sulfates are the alkali metal salts, and especially the sodium salts, of the sulfuric monoesters of $C_{12}$–$C_{18}$ fatty alcohols, examples being those of coconut fatty alcohol, tallow fatty alcohol, lauryl, myristyl, cetyl or stearyl alcohol, or of $C_{10}$–$C_{20}$ oxo alcohols, and those monoesters of secondary alcohols of these chain lengths. Preference is also given to alk(en)yl sulfates of said chain length which contain a synthetic straight-chain alkyl radical prepared on a petrochemical basis, these sulfates possessing degradation properties similar to those of the corresponding compounds based on fatty-chemical raw materials. From a detergents standpoint, the $C_{12}$–$C_{16}$ alkyl sulfates and $C_{12}$–$C_{15}$ alkyl sulfates, and also $C_{14}$–$C_{15}$ alkyl sulfates, are preferred. In addition, 2,3-alkyl sulfates, which may, for example, be prepared in accordance with the U.S. Pat. Nos. 3,234,258 or 5,075,041 and obtained as commercial products from Shell Oil Company under the name DAN®, are suitable anionic surfactants.

Also suitable are the sulfuric monoesters of the straight-chain or branched $C_{7-21}$ alcohols ethoxylated with from 1 to 6 mol of ethylene oxide, such as 2-methyl-branched $C_{9-11}$ alcohols containing on average 3.5 mol of ethylene oxide (EO) or $C_{12-18}$ fatty alcohols containing from 1 to 4 EO. Because of their high foaming behavior they are used in cleaning products only in relatively small amounts, for example, in amounts of from 1 to 5% by weight.

Further suitable anionic surfactants include the salts of alkylsulfosuccinic acid, which are also referred to as sulfosuccinates or as sulfosuccinic esters and which constitute monoesters and/or diesters of sulfosuccinic acid with alcohols, preferably fatty alcohols and especially ethoxylated fatty alcohols. Preferred sulfosuccinates comprise $C_{8-18}$ fatty alcohol radicals or mixtures thereof. Especially preferred sulfosuccinates contain a fatty alcohol radical derived from ethoxylated fatty alcohols which themselves represent nonionic surfactants (for description, see below). Particular preference is given in turn to sulfosuccinates whose fatty alcohol radicals are derived from ethoxylated fatty alcohols having a narrowed homolog distribution. Similarly, it is also possible to use alk(en)ylsuccinic acid containing preferably 8 to 18 carbon atoms in the alk(en)yl chain, or salts thereof.

Further suitable anionic surfactants are, in particular, soaps. Suitable soaps include saturated fatty acid soaps, such as the salts of lauric acid, myristic acid, palmitic acid, stearic acid, hydrogenated erucic acid and behenic acid, and, in particular, mixtures of soaps derived from natural fatty acids, e.g., coconut, palm kernel, or tallow fatty acids.

The anionic surfactants, including the soaps, may be present in the form of their sodium, potassium or ammonium salts and also as soluble salts of organic bases, such as mono-, di- or triethanolamine. Preferably, the anionic surfactants are in the form of their sodium or potassium salts, in particular in the form of the sodium salts.

In the context of the selection of the anionic surfactants, there are no boundary conditions to be observed that stand in the way of freedom to formulate. In preferred process variants, however, the surfactant component has a soap content which exceeds 0.2% by weight, based on the overall weight of the resulting granules. In particularly preferred processes, the flowable component comprising surfactant further comprises soaps in amounts of from 1 to 30% by weight, preferably from 2 to 25% by weight, and in particular from 5 to 20% by weight, based in each case on the surfactant component.

Anionic surfactants preferred for use are in general the alkylbenzenesulfonates and fatty alcohol sulfates, with preferred surfactant granules comprising more than 5% by weight, preferably more than 15% by weight, and in particular more than 25% by weight of alkylbenzenesulfonate (s) and/or fatty alcohol sulfate(s), based in each case on the granule weight.

Besides the anionic surfactants, the nonionic surfactants are the most important surface-active compounds. In addition to anionic surfactants or else instead of them, the flowable component comprising surfactant may comprise nonionic surfactant(s), preference being given to processes wherein the flowable component comprising surfactant comprises nonionic surfactant(s) in amounts of from 1 to 100% by weight, preferably from 2 to 70% by weight, and in particular from 5 to 30% by weight, based in each case on the surfactant component.

Nonionic surfactants used are preferably alkoxylated, advantageously ethoxylated, especially primary, alcohols having preferably 8 to 18 carbon atoms and on average from 1 to 12 mol of ethylene oxide (EO) per mole of alcohol, in which the alcohol radical may be linear or, preferably, methyl-branched in position 2 and/or may comprise linear and methyl-branched radicals in a mixture, as are customarily present in oxo alcohol radicals. Particular preference is given, however, to alcohol ethoxylates containing linear radicals from alcohols of natural origin having 12 to 18 carbon atoms, e.g., from coconut, palm, tallow fatty or oleyl alcohol and on average from 2 to 8 EO per mole of alcohol. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO, and mixtures thereof, such as mixtures of $C_{12-14}$ alcohol containing 3 EO and $C_{12-18}$ alcohol containing 5 EO. The stated degrees of ethoxylation represent statistical mean values, which for a specific product may be an integer or a fraction. Preferred alcohol ethoxylates have a narrowed homolog distribution (narrow range ethoxylates, NREs). In addition to these nonionic surfactants it is also possible to use fatty alcohols containing more than 12 EO. Examples thereof are tallow fatty alcohol containing 14 EO, 25 EO, 30 EO or 40 EO.

The use of alkoxylated nonionic surfactants is preferred in the context of the present invention. Process variants wherein the flowable component comprising surfactant comprises alkoxylated, preferably ethoxylated, nonionic surfactants in amounts of from 20 to 90% by weight, preferably from 30 to 85% by weight, and in particular from 40 to 80% by weight, based in each case on the surfactant component, have advantages, particular preference being given to processes wherein the flowable component comprising surfactant comprises as ethoxylated nonionic surfactant the reaction products of $C_{8-22}$ fatty alcohols, preferably $C_{12-20}$ fatty alcohols and in particular $C_{14-18}$ fatty alcohols with from 1 to 30 mol of ethylene oxide, preferably from 2 to 20 mol of ethylene oxide, and in particular from 5 to 10 mol of ethylene oxide, in amounts of from 10 to 80% by weight, preferably from 20 to 75% by weight, and in particular from 30 to 70% by weight, based in each case on the surfactant component.

A further class of nonionic surfactants used with preference, which are used either as sole nonionic surfactant or in combination with other nonionic surfactants, are alkoxylated, preferably ethoxylated, or ethoxylated and propoxylated, fatty acid alkyl esters, preferably having 1 to 4 carbon atoms in the alkyl chain, especially fatty acid methyl esters, as are described, for example, in the Japanese patent application JP 58/217598, or those prepared preferably by the process described in the international patent application WO-A-90/13533.

A further class of nonionic surfactants which may be used with advantage are the alkyl polyglycosides (APGs). Alkyl polyglycosides which can be employed satisfy the general formula $RO(G)_z$, where R is a linear or branched aliphatic radical, especially an aliphatic radical methyl-branched in position 2, saturated or unsaturated and containing 8 to 22, preferably 12 to 18, carbon atoms, and G is the symbol representing a glycose unit having 5 or 6 carbon atoms, preferably glucose. The degree of glycosidation, z, is between 1.0 and 4.0, preferably between 1.0 and 2.0, and in particular between 1.1 and 1.5.

Preference is given to the use of linear alkyl polyglucosides, i.e., alkyl polyglycosides in which the polyglycosyl radical is a glucose radical and the alkyl radical is an n-alkyl radical.

The surfactant granules of the invention may preferably include alkyl polyglycosides, in which case granule APG contents of more than 0.2% by weight, based on the overall granules, are preferred. Particularly preferred surfactant granules comprise APGs in amounts of from 0.2 to 10% by weight, preferably from 0.2 to 5% by weight, and in particular from 0.5 to 3% by weight.

Nonionic surfactants of the amine oxide type, examples being N-cocoalkyl-N,N-dimethylamine oxide and N-tallowalkyl-N,N-dihydroxyethylamine oxide, and of the fatty acid alkanolamide type, may also be suitable. The amount of these nonionic surfactants is preferably not more than that of the ethoxylated fatty alcohols, in particular not more than half thereof.

Further suitable surfactants are polyhydroxy fatty acid amides of the formula (I),

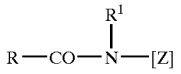

(I)

where RCO is an aliphatic acyl radical having 6 to 22 carbon atoms, $R^1$ is hydrogen or an alkyl or hydroxyalkyl radical having 1 to 4 carbon atoms, and [Z] is a linear or branched polyhydroxyalkyl radical having 3 to 10 carbon atoms and from 3 to 10 hydroxyl groups. The polyhydroxy fatty acid amides are known substances which are customarily obtainable by reductive amination of a reducing sugar with ammonia, an alkylamine or an alkanolamine, and subsequent acylation with a fatty acid, a fatty acid alkyl ester or a fatty acid chloride.

The group of the polyhydroxy fatty acid amides also includes compounds of the formula (II)

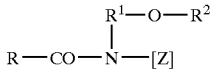

(II)

where R is a linear or branched alkyl or alkenyl radical having 7 to 12 carbon atoms, $R^1$ is a linear, branched or cyclic alkyl radical or an aryl radical having 2 to 8 carbon atoms and $R^2$ is a linear, branched or cyclic alkyl radical or an aryl radical or an oxyalkyl radical having 1 to 8 carbon atoms, preference being given to $C_{1-4}$ alkyl radicals or phenyl radicals, and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a reduced sugar, e.g., glucose, fructose, maltose, lactose, galactose, mannose, or xylose. The N-alkoxy- or N-aryloxy-substituted compounds may then be converted to the desired polyhydroxy fatty acid amides, for example, in accordance with the teaching of the international application WO-A-95/07331 by reaction with fatty acid methyl esters in the presence of an alkoxide catalyst.

In accordance with the invention, the flowable component comprising surfactant may consist entirely of one or more surfactants and may therefore be free from nonsurfactant compounds. It is also possible in accordance with the invention, however, to incorporate further ingredients of laundry detergents and cleaning products into the surfactant component. Besides active substances, the surfactant component may as a result of its preparation include water, and it is also possible for this water to be added in order to establish advantageous viscosity values or to optimize the foaming process of the surfactant component. In preferred processes, however, the flowable component comprising surfactant contains less than 20% by weight, preferably less than 15% by weight, and in particular less than 10% by weight of water, based in each case on the surfactant component.

Those components in particular known as "minor" components may, in accordance with the process of the invention, advantageously be introduced into the surfactant granules by way of the foam which is used as granulating fluid. In preferred processes of the invention, the flowable component comprising surfactant comprises further ingredients of laundry detergents and cleaning products, especially substances from the group of the complexing agents, polymers, optical brighteners, dyes, fragrances, and alkalis. These minor components which are preferably to be added to the flowable component comprising surfactant are described later on below.

Depending on the desired properties of the foam, the foaming of the flowable component comprising surfactant may take place at room temperature or with cooling or heating. Preferred process variants are conducted in such a way that the flowable component comprising surfactant that is to be foamed has temperatures, prior to foaming, of from 20 to 120° C., preferably from 30 to 90° C., and in particular from 50 to 75° C. Through the selection of the ingredients it is possible to vary the viscosity of the surfactant component within wide limits, with more mobile surfactant components generally giving less stable foams.

As already mentioned above, it is an advantage of the process of the invention that, in contrast to conventional granulation methods, it is also possible to use granulating fluids whose viscosity is high. Accordingly, in the process of the invention, it is possible to use surfactant fluid components whose viscosity is above 100 mPas, but also liquid components having viscosities above 1000 mPas, indeed even above 5000 mPas, may be foamed in accordance with the invention and used as granulating auxiliaries in the form of the "granulating foam" without problems. The process of the invention is also of particular interest when two liquid components are to be used whose mixture would have an excessive viscosity or which form gel phases on mixing. In this case, in accordance with the invention, a surfactant liquid component may be foamed and this foam may be combined with the foam generated from another liquid component and used subsequently as the granulating foam. In this context it is not absolutely necessary for the second liquid component to comprise surfactant, although for reasons of foam stability this may be preferred. By this means, the problem of an overall mixture whose viscosity is too high for the fine-pored foaming is elegantly circumvented.

The flowable component comprising surfactant is foamed by the gaseous medium into a foam, it being possible to employ liquid and gaseous medium in varying amounts or proportions with respect to one another. From a processing standpoint it is preferred to generate the foam using the gaseous medium in each case in amounts of at least 20% by volume, based on the amount of liquid to be foamed.

If, therefore, for example, one liter of a surfactant component is to be foamed, it is preferred to carry out foaming using at least 200 ml of gaseous medium. In preferred processes the amount of gaseous medium is significantly above this level, so that preference is given to processes wherein the amount of gas used for foaming is from one to three hundred times, preferably from five to two hundred times, in particular from ten to one hundred times, the volume of the amount of liquid to be foamed. As already mentioned earlier above, the gaseous medium used in this context is preferably air. It is, however, also possible to use other gases or gas mixtures for foaming. For example, it may be preferred to pass air or oxygen-enriched air through an ozonizer before the gas is used for foaming. In this way it is possible to prepare gas mixtures containing, for example, from 0.1 to 4% by weight of ozone. The ozone content of the foaming gas then leads to the oxidative destruction of unwanted constituents in the liquids to be foamed. Especially in the case of partly discolored anionic surfactant acids, the admixture of ozone may result in a significant lightening.

In order to foam the liter of surfactant component cited by way of example above, therefore, it is preferred to use from 1 to 300 liters, more preferably from 5 to 200 liters, and in particular from 10 to 100 liters of air.

By way of the temperature of the liquid to be foamed, on the one hand, and the temperature of the gaseous medium, on the other hand, it is possible to control the temperature of the resulting foam. In preferred variants of the process of the invention, the resulting foam has temperatures below 115° C., preferably between 20 and 80° C., and in particular between 30 and 70° C.

The resulting foam, which is used as granulating auxiliary in the next process step, may be characterized by further physical parameters. Thus it is preferred, for example, for the foam to have a density below 0.80 g $cm^{-3}$, preferably from 0.10 to 0.6 g $cm^{-3}$, and in particular from 0.30 to 0.55 g $cm^{-3}$. It is further preferred for the foam to have average pore sizes below 10 mm, preferably below 5 mm, and in particular below 2 mm.

The abovementioned physical parameters of temperature, density and average pore size characterize the foam at the moment at which it is formed. Preferably, however, the process regime is chosen so that the foam still meets the abovementioned criteria when it is added to the mixer.

In this context, process regimes are possible in which the foam meets only one or two of the abovementioned criteria at the time of addition to the mixer; preferably, however, both the temperature and also the density and pore size lie within the stated ranges when the foam enters the mixer.

Following its formation, the foam is applied to a bed of solids charged to a mixer, where it acts as granulating auxiliary. This process stage may be conducted in any of a very wide variety of mixing and granulating apparatus, as described in detail later on below. The bed of solids charged to the mixer may comprise all of the substances used in laundry detergents and cleaning products. In this way, finished laundry detergents and cleaning products may be prepared with the process of the invention. Normally, however, certain ingredients of laundry detergents and cleaning products are not included in the granulating stage, in order to avoid unwanted reactions of these constituents with one another under the mechanical action of the granulating tools. Ingredients which are normally not added to the resulting surfactant granules until subsequently, i.e., following a granulation, include, for example, bleaches, bleach activators, enzymes, and foam inhibitors.

Preferably, the surfactant granules prepared in accordance with the invention comprise, besides the surfactant, substances which function as active substances in the subsequent laundry detergent and cleaning product. In preferred processes, therefore, the bed of solids charged to the mixer comprises one or more substances from the group consisting of builders, especially alkali metal carbonates, alkali metal sulfates and alkali metal silicates, zeolites, and polymers.

Besides the detersive substances, builders are the most important ingredients of laundry detergents and cleaning products. The bed of solids in the process of the invention may comprise all of the builders commonly used in laundry detergents and cleaning products, i.e., in particular, zeolites, silicates, carbonates, organic cobuilders, and—where there are no ecological prejudices against their use—phosphates as well.

Suitable crystalline, layered sodium silicates possess the general formula $NaMSi_xO_{2x+1}.yH_2O$, where M is sodium or hydrogen, x is a number from 1.9 to 4, y is a number from 0 to 20, and preferred values for x are 2, 3 or 4. Crystalline phyllosilicates of this kind are described, for example, in the European patent application EP-A-0 164 514. Preferred crystalline phyllosilicates of the formula indicated are those in which M is sodium and x adopts the value 2 or 3. In particular, both β- and δ-sodium disilicates $Na_2Si_2O_5.yH_2O$ are preferred, β-sodium disilicate, for example, being obtainable by the process described in the international patent application WO-A-91/08171.

It is also possible to use amorphous sodium silicates having an $Na_2O:SiO_2$ modulus of from 1:2 to 1:3.3, preferably from 1:2 to 1:2.8, and in particular from 1:2 to 1:2.6, which are dissolution-retarded and have secondary washing properties. The retardation of dissolution relative to conventional amorphous sodium silicates may have been brought about in a variety of ways—for example, by surface treatment, compounding, compacting, or overdrying. In the context of this invention, the term "amorphous" also embraces "X-ray-amorphous". This means that in X-ray diffraction experiments the silicates do not yield the sharp X-ray reflections typical of crystalline substances but instead yield at best one or more maxima of the scattered X-radiation, having a width of several degree units of the diffraction angle. However, good builder properties may result, even particularly good builder properties, if the silicate particles in electron diffraction experiments yield blurred or even sharp diffraction maxima. The interpretation of this is that the products have microcrystalline regions with a size of from 10 to several hundred nm, values up to max. 50 nm and in particular up to max. 20 nm being preferred. So-called X-ray-amorphous silicates of this kind, which likewise possess retarded dissolution relative to the conventional waterglasses, are described, for example, in the German patent application DE-A-44 00 024. Particular preference is given to compacted amorphous silicates, compounded amorphous silicates, and overdried X-ray-amorphous silicates.

The finely crystalline, synthetic zeolite used, containing bound water, is preferably zeolite A and/or P. As zeolite P, particular preference is given to Zeolite MAP® (commercial product from Crosfield). Also suitable, however, are zeolite X and also mixtures of A, X and/or P. Available commercially and suitable for preferred use in the context of the present invention is, for example, a cocrystallizate of zeolite X and zeolite A (approximately 80% by weight zeolite X), which is sold by CONDEA Augusta S.p.A. under the brand name VEGOBOND AX® and may be described by the formula $$nNa_2O.(1-n)K_2O.Al_2O_3.(2-2.5)SiO_2.(3.5-5.5)H_2O.$$

Suitable zeolites have an average particle size of less than 10 $\mu$m (volume distribution; measurement method: Coulter counter) and contain preferably from 18 to 22% by weight, in particular from 20 to 22% by weight, of bound water.

Of course, the widely known phosphates may also be used as builder substances provided such a use is not to be avoided on ecological grounds. Of particular suitability are the sodium salts of the orthophosphates, the pyrophosphates and, in particular, the tripolyphosphates.

Organic builder substances which may be used are, for example, the polycarboxylic acids, usable in the form of their sodium salts, such as citric acid, adipic acid, succinic acid, glutaric acid, tartaric acid, sugar acids, aminocarboxylic acids, nitrilotriacetic acid (NTA), provided such use is not objectionable on ecological grounds, and also mixtures thereof. Preferred salts are the salts of the polycarboxylic acids such as citric acid, adipic acid, succinic acid, glutaric acid, tartaric acid, sugar acids, and mixtures thereof.

The bed of solids charged to the mixer may also comprise compounded raw materials, i.e., ingredients which are themselves an end product of previous process steps. Besides granulated, compacted or extruded raw materials, spray-dried base powders are also appropriate constituents of the bed of solids charged to the mixer. These spray-dried base powders may be surfactant-free (for example, compounded polymers), but preferably comprise surfactants. Where spray-dried base powders of this kind are to be used, the bed of solids charged to the mixer, based on the solids charged to the mixer, comprises—in preferred process variants—the spray-dried base powders, preferably the surfactant-containing spray-dried base powders, in amounts of from 10 to 80% by weight, preferably from 15 to 70% by weight, and in particular from 20 to 60% by weight.

By the addition of foam and under the action of the mixer tools, surfactant granules are formed. Preference is given in this context to processes of the invention wherein the surfactant foam is applied in a weight ratio of foam:solids of from 1:100 to 9:1, preferably from 1:30 to 2:1, and in particular from 1:20 to 1:1, to the bed of solids charged to the mixer. With the preferred amounts of granulating auxiliary (surfactant foam), optimum granulation results are achieved.

As already mentioned, the process of the invention may be conducted in a large number of customary mixing and granulating apparatus. Examples of mixers suitable for conducting the process of the invention are Eirich® mixers of series R or RV (trademark of Maschinenfabrik Gustav Eirich, Hardheim), the Schugi® Flexomix, the Fukae® FS-G mixers (trademark of Fukae Powtech, Kogyo Co., Japan), the Lödige® FM, KM and CB mixers (trademark of Lödige Maschinenbau GmbH, Paderborn), and the Drais® series T or K-T (trademark of Drais-Werke GmbH, Mannheim). Some preferred embodiments of the process of the invention are described below.

For example, it is possible and preferred to conduct the process of the invention in a low-speed mixer/granulator at peripheral speeds of from 2 m/s to 7 m/s, the surfactant foam being applied to the bed of solids charged to the mixer in a time of between 0.5 and 10 minutes, preferably between 1 and 7 minutes, and in particular between 2 and 5 minutes.

Alternatively, in preferred process variants, the surfactant foam may be added to the bed of solids charged to the mixer in a high-speed mixer/granulator at peripheral speeds of from 8 m/s to 35 m/s in a time of between 0.1 and 30 seconds, preferably up to 10 seconds, and in particular between 0.5 and 2 seconds.

Whereas the two above-described process variants describe the use of in each case one mixer, it is also possible in accordance with the invention to combine two mixers with one another. For example, preference is given to processes wherein the surfactant foam is applied to an agitated bed of solids in a first, low-speed mixer/granulator, with from 40 to 100% by weight, based on the overall amount of the constituents used, of the solid and liquid constituents being pregranulated, and in a second, high-speed mixer/granulator the pregranulated product from the first process stage is mixed if appropriate with the remaining solid and/or liquid constituents and is converted into granules. In the case of this process variant, the surfactant foam in the first mixer/granulator is applied to a bed of solids and the mixture is pregranulated. The composition of the foam and of the bed of solids charged to the first mixer are chosen such that from 40 to 100% by weight, preferably from 50 to 90% by weight, and in particular from 60 to 80% by weight of the solid and liquid constituents, based on the overall amount of the constituents used, are present in the pregranulated product. This pregranulated product is then mixed with further solids in the second mixer and, with the addition of further liquid components, is granulated to give the finished surfactant granules. In accordance with the invention it is possible and preferred for the liquid constituents in the second process step as well not to be applied in liquid form using nozzles but instead to be used as granulating auxiliary (granulating fluid) in the form of a foam. The composition of the foam applied in the second mixer may differ from the composition of the foam used in the first mixer, so that preference is given to above-described processes wherein, in the second, high-speed mixer/granulator the pregranulated product from the first process stage is granulated to give the finished granules likewise with the addition of a surfactant foam whose composition may differ from the foam used in the first process stage.

The stated sequence of low-speed/high-speed mixers may also be reversed in accordance with the invention, resulting in a process of the invention wherein the surfactant foam is applied to an agitated bed of solids in a first, high-speed mixer/granulator, with from 40 to 100% by weight, based on the overall amount of the constituents used, of the solid and liquid constituents being pregranulated, and in a second, low-speed mixer/granulator the pregranulated product from the first process stage is mixed if appropriate with the remaining solid and/or liquid constituents and converted into granules.

In the case of this process variant, the comments made above may be applied analogously, so that, here again, preference is given to processes wherein, in the second, low-speed mixer/granulator, the pregranulated product from the first process stage is granulated to give the finished granules likewise with the addition of a surfactant foam whose composition may differ from the foam used in the first process stage.

All of the above-described variant embodiments of the process of the invention may be conducted batchwise or continuously. In the above-described variant embodiments of the process of the invention, use is made in some cases of high-speed mixer/granulators. In the context of the present invention it is particularly preferred for the high-speed mixer used to be a mixer which has both a mixing means and a size reduction means, the mixing shaft being operated at peripheral speeds of from 50 to 150 revolutions/minute, preferably from 60 to 80 revolutions/minute, and the shaft of the size reduction means being operated at peripheral speeds of from 500 to 5 000 revolutions/minute, preferably from 1 000 to 3 000 revolution/minute.

With regard to the selection of the ingredients to be used and their concentration, the process of the invention may be varied over a wide range. Irrespective of this it is preferred if, in accordance with the invention, surfactant granules are prepared which have surfactant contents of more than 10% by weight, preferably more than 15% by weight, and in particular more than 20% by weight, based in each case on the granules, and bulk densities of more than 600 g/l, preferably more than 700 g/l, and in particular more than 800 g/l.

The granulation process of the invention may be conducted in such a way that particles of a predetermined size distribution result. In this case, preference is given to processes of the invention wherein the surfactant granules have a particle size distribution in which at least 50% by weight, preferably at least 60% by weight, and in particular at least 70% by weight of the particles possess sizes in the range from 400 to 1600 $\mu$m. The residual moisture content of the surfactant granules prepared in accordance with the invention may also be predetermined by way of the selection of the raw materials, so that subsequent drying steps may be omitted. In preferred processes, the surfactant granules have residual free water contents of from 2 to 15% by weight, preferably from 4 to 10% by weight, based on the surfactant granules. The residual free water content may be determined, for example, by means of a modified UX method (Sartorius MA 30, program 120° C. over 10 minutes).

In accordance with the process of the invention it is possible to prepare laundry detergent and cleaning product components which give the finished laundry detergent and cleaning product only after blending with further ingredients. It is of course also possible, however, in accordance with the invention to prepare surfactant granules which already, taken per se, are a finished laundry detergent and cleaning product (for example, a textile color laundry detergent).

The surfactant granules prepared by the process of the invention may subsequently be blended with further ingredients of laundry detergents and cleaning products to give the finished product. If desired, however, these ingredients may also be incorporated directly into the surfactant granules by way of the bed of solids or by way of the surfactant foam, and are described below:

Besides the abovementioned constituents surfactant and builders, customary ingredients that are of particular importance in laundry detergents and cleaning products include those from the group of the bleaches, bleach activators, enzymes, pH modifiers, fragrances, perfume carriers, fluorescers, dyes, foam inhibitors, silicone oils, antiredeposition agents, optical brighteners, graying inhibitors, color transfer inhibitors, and corrosion inhibitors.

Among the compounds which serve as bleaches and which in water give $H_2O_2$, particular significance is possessed by sodium perborate tetrahydrate and sodium perborate monohydrate. Examples of further bleaches which may be used are sodium percarbonate, peroxypyrophosphates, citrate perhydrates, and also $H_2O_2$-donating peracidic salts or peracids, such as perbenzoates, peroxophthalates, diperazelaic acid, phthaloimino peracid, or diperdodecanedioic acid. Typical organic bleaches are the diacyl peroxides, such as dibenzoyl peroxide, for example. Further typical organic bleaches are the peroxy acids, particular examples being the alkylperoxy acids and the arylperoxy acids. Preferred representatives which may be employed are (a) peroxybenzoic acid and its ring-substituted derivatives, such as alkylperoxybenzoic acids, and also peroxy-$\alpha$-naphthoic acid and magnesium monoperphthalate, (b) the aliphatic or substituted aliphatic peroxy acids, such as peroxylauric acid, peroxystearic acid, $\epsilon$-phthalimidoperoxycaproic acid [phthaloiminoperoxyhexanoic acid (PAP)], o-carboxybenzamidoperoxycaproic acid, N-nonenylamidoperadipic acid, and N-nonenylamidopersuccinates, and (c) aliphatic and araliphatic peroxydicarboxylic acids, such as 1,12-diperoxydodecanoic acid, 1,9-diperoxyazelaic acid, diperoxysebacic acid, diperoxybrassylic acid, the diperoxyphthalic acids, 2-decyldiperoxybutane-1,4-dioic acid, and N,N-terephthaloyldi(6-aminopercaproic acid).

As bleaches in compositions for machine dishwashing it is also possible to use substances which release chlorine or bromine. Among the suitable chlorine- or bromine-releasing materials, suitable examples include heterocyclic N-bromo- and N-chloroamides, examples being trichloroisocyanuric acid, tribromoisocyanuric acid, dibromoisocyanuric acid and/or dichloroisocyanuric acid (DICA) and/or their salts with cations such as potassium and sodium. Hydantoin compounds, such as 1,3-dichloro-5,5-dimethylhydantoin, are likewise suitable.

Bleach activators may be incorporated in order to achieve an improved bleaching action when washing or cleaning at temperatures of 60° C. or below. Bleach activators which may be used are compounds which under perhydrolysis conditions give rise to aliphatic peroxocarboxylic acids having preferably 1 to 10 carbon atoms, in particular 2 to 4 carbon atoms, and/or substituted or unsubstituted perbenzoic acid. Suitable substances are those which carry O-acyl and/or N-acyl groups of the stated number of carbon atoms, and/or substituted or unsubstituted benzoyl groups. Preference is given to polyacylated alkylenediamines, especially tetraacetylethylenediamine (TAED), acylated triazine derivatives, especially 1,5-diacetyl-2,4-dioxohexahydro-1,3,5-triazine (DADHT), acylated glycolurils, especially tetraacetylglycoluril (TAGU), N-acylimides, especially N-nonanoylsuccinimide (NOSI), acylated phenolsulfonates, especially n-nonanoyl- or isononanoyloxybenzenesulfonate (n- or iso-NOBS), carboxylic anhydrides, especially phthalic anhydride, acylated polyhydric alcohols, especially triacetin, ethylene glycol diacetate, and 2,5-diacetoxy-2,5-dihydrofuran.

In addition to the conventional bleach activators, or instead of them, it is also possible to incorporate what are known as bleaching catalysts. These substances are bleach-boosting transition metal salts or transition metal complexes such as, for example, Mn—, Fe—, Co—, Ru— or Mo-salen complexes or -carbonyl complexes. Other bleaching catalysts which can be used include Mn, Fe, Co, Ru, Mo, Ti, V and Cu complexes with N-containing tripod ligands, and also Co—, Fe—, Cu— and Ru-ammine complexes.

Suitable enzymes include those from the class of the proteases, lipases, amylases, cellulases, and mixtures of said enzymes. Especially suitable enzymatic active substances are those obtained from bacterial strains or fungi, such as *Bacillus subtilis, Bacillus licheniformis*, and *Streptomyces griseus*. Preference is given to the use of proteases of the subtilisin type, and especially to proteases obtained from *Bacillus lentus*. Of particular interest in this context are enzyme mixtures, examples being those of protease and amylase or protease and lipase or protease and cellulase or of cellulase and lipase or of protease, amylase and lipase or protease, lipase and cellulase, but especially cellulase-containing mixtures. Peroxidases or oxidases have also proven suitable in some cases. The enzymes may be adsorbed on carrier substances and/or embedded in coating substances in order to protect them against premature decomposition.

In addition, it is also possible to use components which have a positive influence on the ease with which oil and fat are washed off from textiles (these components being known as soil repellents). This effect becomes particularly marked when a textile is soiled that has already been laundered previously a number of times with a detergent of the invention comprising this oil- and fat-dissolving component. The preferred oil- and fat-dissolving components include, for example, nonionic cellulose ethers such as methylcellulose and methylhydroxypropylcellulose having a methoxy group content of from 15 to 30% by weight and a hydroxypropoxy group content of from 1 to 15% by weight, based in each case on the nonionic cellulose ether, and also the prior art polymers of phthalic acid and/or terephthalic acid, and/or derivatives thereof, especially polymers of ethylene terephthalates and/or polyethylene glycol terephthalates or anionically and/or nonionically modified derivatives thereof. Of these, particular preference is given to the sulfonated derivatives of phthalic acid polymers and of terephthalic acid polymers.

The laundry detergents and cleaning products may comprise as optical brighteners derivatives of diaminostilbenedisulfonic acid and/or the alkali metal salts thereof. Examples of suitable brighteners are salts of 4,4'-bis(2-anilino-4-morpholino-1,3,5-triazinyl-6-amino)stilbene-2,2'-disulfonic acid or compounds of similar structure which instead of the morphilino group carry a diethanolamino group, a methylamino group, an anilino group, or a 2-methoxyethylamino group. Furthermore, brighteners of the substituted diphenylstyryl type may be present, examples being the alkali metal salts of 4,4'-bis(2-sulfostyryl)biphenyl, 4,4'-bis(4-chloro-3-sulfostyryl)-biphenyl, or 4-(4-chlorostyryl)-4'-(2-sulfostyryl)-biphenyl. Mixtures of the abovementioned brighteners may also be used.

Dyes and fragrances are added to laundry detergents and cleaning products in order to enhance the esthetic appeal of the products and to provide the consumer with not only the performance of the product but also a visually and sensorially "typical and unmistakable" product. As perfume oils and/or fragrances it is possible to use individual odorant compounds, examples being the synthetic products of the ester, ether, aldehyde, ketone, alcohol, and hydrocarbon types. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate, and benzyl salicylate. The ethers include, for example, benzyl ethyl ether; the aldehydes include, for example, the linear alkanals having 8–18 carbon atoms, citral, citronellal, citronellyloxyacetaldehyde, cyclamen aldehyde, hydroxycitronellal, lilial and bourgeonal; the ketones include, for example, the ionones, α-isomethylionone and methyl cedryl ketone; the alcohols include anethol, citronellol, eugenol, geraniol, linalool, phenylethyl alcohol, and terpineol; the hydrocarbons include primarily the terpenes such as limonene and pinene. Preference, however, is given to the use of mixtures of different odorants, which together produce an appealing fragrance note. Such perfume oils may also contain natural odorant mixtures, as obtainable from plant sources, examples being pine oil, citrus oil, jasmine oil, patchouli oil, rose oil or ylang-ylang oil. Likewise suitable are muscatel, sage oil, camomile oil, clove oil, balm oil, mint oil, cinnamon leaf oil, lime blossom oil, juniperberry oil, vetiver oil, olibanum oil, galbanum oil and labdanum oil, and also orange blossom oil, neroli oil, orange peel oil, and sandalwood oil.

The dye content of laundry detergents and cleaning products is usually below 0.01% by weight, while fragrances may account for up to 2% by weight of the overall formulation.

The fragrances may be incorporated directly into the laundry detergents and cleaning products; alternatively, it may be advantageous to apply the fragrances to carriers which intensify the adhesion of the perfume on the laundry and, by means of slower fragrance release, ensure long-lasting fragrance of the textiles. Materials which have become established as such carriers are, for example, cyclodextrins, it being possible in addition for the cyclodextrin-perfume complexes to be additionally coated with further auxiliaries.

In order to enhance the esthetic impression of laundry detergents and cleaning products they may be colored with appropriate dyes. Preferred dyes, whose selection causes no difficulty whatsoever to the skilled worker, possess a high level of stability on storage and a high level of insensitivity to the other ingredients of the compositions and to light, and also do not have any pronounced affinity for textile fibers, so as not to stain them.

The foam prepared in the process of the invention, and its use as a granulation auxiliary, have not hitherto been described in the state of the art. The present invention therefore additionally provides a surfactant foam obtainable by exposing a flowable component comprising surfactant to a gaseous medium, wherein the foam has average pore sizes of less than 10 mm, preferably less than 5 mm, and in particular less than 2 mm.

As already highlighted in the context of the description of the process of the invention, preference is given to a surfactant foam wherein the gaseous medium accounts for at least 20% by volume, based on the amount of liquid to be foamed. In the case of a particularly preferred surfactant foam, the gaseous medium accounts for from one to three hundred times, preferably from five to two hundred times, and in particular from ten to one hundred times, the volume of the amount of liquid to be foamed.

The surfactant foam of the invention preferably has a high surfactant content. Surfactant foams which have surfactant contents of from 50 to 99% by weight, preferably from 60 to 95% by weight, and in particular from 70 to 90% by weight, based in each case on the weight of the foam, are preferred in this context.

The present invention further provides for the use of the surfactant foams of the invention as a granulating fluid for the preparation of surfactant granules. With regard to the proportions of granulating auxiliary (surfactant foam) to bed of solids, the mixers to be used, and the ingredients which may be used in the bed of solids, reference may be made here to the remarks above.

EXAMPLES

A flowable component comprising surfactant, of the composition indicated in Table 1, was metered at a temperature of 80° C. into a tube section equipped with a nonreturn valve and was foamed by means of sinter disks using compressed air (16 $m^3$/h). The resulting foam (density: 0.45 g $cm^{-3}$ pore size <1 mm, temperature: 75° C.) was fed in a foam:solids ratio of ~1:4.7 into a plowshare mixer with 2 blade heads (type KM300-D, Gebrüder Lödige, Paderborn (DE)), the foam impinging in the region of the first blade head on the agitated bed of solids (for composition see Table 2). This resulted in pure-white, free-flowing surfactant granules whose composition is indicated in Table 3 and whose physical properties are summarized in Table 4.

TABLE 1

| Composition of the flowable surfactant component [% by weight] | |
|---|---|
| Na $C_{9-13}$ alkylbenzenesulfonate | 52.2 |
| $C_{12-18}$ soap | 5.4 |
| $C_{12-18}$ fatty alcohol containing 7 EO | 28.8 |
| HEDP* | 2.3 |
| Water | 11.3 |

*Hydroxyethane-1,1-diphosphonic acid, tetrasodium salt

TABLE 2

| Composition of the bed of solids [% by weight] | |
|---|---|
| Zeolite A (Wessalith ® P, Degussa) | 36.1 |
| Sodium sulfate | 32.0 |
| Sodium carbonate | 21.2 |
| Sokalan ® CP 5, 50% in water** | 10.7 |

**Acrylic acid-maleic acid copolymer (BASF)

TABLE 3

| Composition of the surfactant granules [% by weight] | |
|---|---|
| Na $C_{9-13}$ alkylbenzenesulfonate | 11.4 |
| $C_{12-18}$ soap | 1.3 |
| $C_{12-18}$ fatty alcohol containing 7 EO | 6.3 |
| Zeolite A (Wessalith ® P, Degussa) | 26.9 |
| Sodium sulfate | 25.6 |
| Sodium carbonate | 17.0 |
| HEDP* | 0.5 |
| Sokalan ® CP 5 | 4.3 |
| Water | 6.7 |

TABLE 4

| Physical data of the surfactant granules | |
|---|---|
| Bulk density [g/l] | 840 |
| Sieve analysis [% by weight] | |
| >1.6 mm | 3 |
| >1.2 mm | 9 |
| >0.8 mm | 26 |
| >0.4 mm | 40 |
| <0.4 mm | 22 |
| Color | pure white |

Further experiments on the production scale were conducted with flowable components, comprising surfactant, of the composition indicated in Table 5. For this purpose, the components were each separately metered at a temperature of 50° C. into tube sections equipped with nonreturn valves and were foamed by means of sinter disks using 50 times the volume of compressed air, and mixed with one another. The resulting foam (density: 0.5 g $cm^{-3}$, pore size <1 mm, temperature: 50° C.) was fed into a plowshare mixer with 2 blade heads (type KM300-D, Gebrüder Lödige, Paderborn (DE)), the foam impinging in the region of the first blade head onto the agitated bed of solids (for composition see Table 6) and the mixer tools being moved at peripheral speeds of 3 m/s. The continuous granulation was operated with a mass discharge of 1 t/h. This resulted, again, in pure-white, free-flowing surfactant granules whose composition is indicated in Table 7 and whose physical properties are summarized in Table 8.

TABLE 5

| Composition of the flowable surfactant components [% by weight] | E2 | E3 | E4 | E5 | E6 |
|---|---|---|---|---|---|
| Sodium silicate solution, 30% by weight | — | 31.2 | 25.9 | — | — |
| Sokalan ® CP 5* | — | — | 22.3 | — | — |
| $C_{12-14}$ alkyl 1,4-glucoside** | — | — | — | — | 39.2 |
| $C_{12-18}$ fatty alcohol containing 7 EO | 10 | 68.8 | 51.8 | 100 | 60.8 |

*Acrylic acid-maleic acid copolymer (BASF), 40% by weight solution in water
**5% by weight solution in water

TABLE 6

| Composition of the bed of solids [% by weight] | E2 | E3 | E4 | E5 | E6 |
|---|---|---|---|---|---|
| Tower powder * | 79.9 | 80.9 | 81.7 | 86.9 | 79.9 |
| Zeolite A (Wessalith ® P, Degussa) | 3.8 | 3.8 | 3.9 | 3.8 | 3.8 |
| Polyethylene glycol 4000 | 2.3 | 2.3 | — | — | 2.3 |
| Sodium citrate | 4.7 | 3.6 | 4.8 | — | 4.7 |
| Fatty alcohol sulfate compound ** | 9.3 | 9.4 | 9.6 | 9.3 | 9.3 |

| * Composition (% by weight): | |
|---|---|
| $C_{9-13}$ alkylbenzenesulfonate | 22.8 |
| Soap | 1.3 |
| $C_{12-18}$ tallow alcohol containing 5 EO | 1.3 |
| Sodium sulfate | 3.8 |
| Zeolite A | 46.4 |
| Acrylic acid-maleic acid copolymer | 8.0 |
| Na hydroxyethane-1,1-diphosphonate | 1.0 |
| NaOH, anhydrous active substance | 0.5 |

TABLE 6-continued

| Composition of the bed of solids [% by weight] | E2 | E3 | E4 | E5 | E6 |
|---|---|---|---|---|---|
| Optical brightener | | | 0.44 | | |
| Water, salts | | | Remainder | | |
| ** Composition: | | | | | |
| 92% by weight $C_{12-18}$ fatty alcohol sulfate | | | | | |
| 3% by weight sodium carbonate | | | | | |
| 5% by weight salts, water | | | | | |

TABLE 7

| Composition of the surfactant granules [% by weight] | E2 | E3 | E4 | E5 | E6 |
|---|---|---|---|---|---|
| Foam (Table 5) | 6.4 | 9.1 | 11.9 | 6.4 | 9.8 |
| Solids (Table 6) | 93.6 | 90.9 | 88.1 | 93.6 | 90.2 |

TABLE 8

| Physical data of the surfactant granules | E2 | E3 | E4 | E5 | E6 |
|---|---|---|---|---|---|
| Bulk density [g/l] | 615 | 544 | 562 | 556 | 515 |
| Sieve analysis [% by weight]: | | | | | |
| >1.6 mm | 2 | 6 | 3 | 5 | 6 |
| >1.2 mm | 7 | 17 | 12 | 14 | 17 |
| >0.8 mm | 21 | 34 | 32 | 33 | 31 |
| >0.4 mm | 32 | 40 | 48 | 47 | 35 |
| <0.4 mm | 38 | 3 | 5 | 1 | 11 |
| Color | pure white | pure white | pure white | Pure white | pure white |

What is claimed is:

1. A process for making surfactant granules, comprising the steps of foaming a liquid comprising a surfactant or surfactants with a gas to form a surfactant foam, and applying the surfactant foam to a bed of solids, and forming the solids into the surfactant granules.

2. The process of claim 1, wherein the liquid comprises 20% to 100% by weight of one or more anionic, nonionic, cationic, or amphoteric surfactants.

3. The process of claim 2, wherein the liquid comprises 50% to 95% by weight of one or more anionic, nonionic, cationic, or amphoteric surfactants.

4. The process of claim wherein the liquid comprises 60% to 90% by weight of one or more anionic, nonionic, cationic, or amphoteric surfactants.

5. The process of claim 1, wherein the liquid comprises 10% to 90% by weight of one or more anionic surfactants.

6. The process of claim 5, wherein the liquid comprises 20% to 85% by weight of one or more anionic surfactants.

7. The process of claim 6, wherein the liquid comprises 30% to 80% by weight of one or more anionic surfactants.

8. The process of claim 1, wherein the liquid comprises 20% to 90% by weight of one or more alkali metal salts of alkylbenzenesulfonic acids.

9. The process of claim 8, wherein the liquid comprises 30% to 85% by weight of one or more alkali metal salts of alkylbenzenesulfonic acids.

10. The process of claim 9, wherein the liquid comprises 40% to 80% by weight of one or more alkali metal salts of alkylbenzenesulfonic acids.

11. The process of claim 1, wherein the liquid comprises 1% to 30% by weight of one or more soaps.

12. The process of claim 11, wherein the liquid comprises 2% to 25% by weight of one or more soaps.

13. The process of claim 12, wherein the liquid comprises 5% to 20% by weight of one or more soaps.

14. The process of claim 1, wherein the liquid comprises 1% to 100% by weight of one or more nonionic surfactants.

15. The process of claim 14, wherein the liquid comprises 2% to 70% by weight of one or more nonionic surfactants.

16. The process of claim 15, wherein the liquid comprises 5% to 30% by weight of one or more nonionic surfactants.

17. The process of claim 14, wherein the liquid comprises 20% to 90% by weight of one or more alkoxylated nonionic surfactants.

18. The process of claim 17, wherein the liquid comprises 20% to 90% by weight of one or more ethoxylated nonionic surfactants.

19. The process of claim 17, wherein the liquid comprises 30% to 85% by weight of one or more alkoxylated nonionic surfactants.

20. The process of claim 17, wherein the liquid comprises 40% to 80% by weight of one or more alkoxylated nonionic surfactants.

21. The process of claim 18, wherein the one or more ethoxylated nonionic surfactants comprise reaction products of $C_{8-22}$ fatty alcohols with from 1 to 30 mole of ethylene oxide.

22. The process of claim 21, wherein the one or more ethoxylated nonionic surfactants comprise reaction products of $C_{12-20}$ fatty alcohols with 2 to 20 mole of ethylene oxide.

23. The process of claim 22, wherein the one or more ethoxylated nonionic surfactants comprise reaction products of $C_{14-18}$ fatty alcohols with 5 to 10 mole of ethylene oxide.

24. The process of claim 14, wherein the liquid comprises 10% to 80% by weight of reaction products of $C_{8-22}$ fatty alcohols with 1 to 30 mole of ethylene oxide.

25. The process of claim 24, wherein the liquid comprises 20% to 75% by weight of reaction products of $C_{12-20}$ fatty alcohols with 2 to 20 mole of ethylene oxide.

26. The process of claim 25, wherein the liquid comprises 30% to 70% by weight of reaction products of $C_{14-18}$ fatty alcohols with 5 to 10 mole of ethylene oxide.

27. The process of claim 1, wherein the liquid comprises less than 20% by weight of water.

28. The process of claim 27, wherein the liquid comprises less than 15% by weight of water.

29. The process of claim 28, wherein the liquid comprises less than 10% by weight of water.

30. The process of claim 1, wherein the liquid comprises one or more ingredients selected from the group consisting of the complexing agents, polymers, optical brighteners, dyes, fragrances, and alkalis.

31. The process of claim 1, wherein the volume of gas used for foaming is one to three hundred times the volume of the liquid being foamed.

32. The process of claim 31, wherein the volume of gas used for foaming is five to two hundred times the volume of the liquid being foamed.

33. The process of claim 32, wherein the volume of gas used for foaming is ten to one hundred times the volume of the liquid being foamed.

34. The process of claim 1, wherein the gas comprises air.

35. The process of claim 1, wherein the liquid prior to foaming has a temperature of 20° C. to 120° C.

36. The process of claim 35, wherein the liquid prior to foaming has a temperature of 30° C. to 90° C.

37. The process of claim 36, wherein the liquid prior to foaming has a temperature of 50° C. to 75° C.

38. The process of claim 1, wherein the surfactant foam is first combined with a second foam and then applied to the bed of solids.

39. The process of claim 38, wherein the second foam comprises a surfactant or surfactants.

40. The process of claim 1, wherein the surfactant foam has a temperature of less than 115° C.

41. The process of claim 40, wherein the surfactant foam has a temperature of between 20° C. and 80° C.

42. The process of claim 41, wherein the surfactant foam has a temperature of between 30° C. and 70° C.

43. The process of claim 1, wherein the surfactant foam has a density of less than 0.80 g/cm$^3$.

44. The process of claim 43, wherein the surfactant foam has a density of from 0.10 g/cm$^3$ to 0.60 g/cm$^3$.

45. The process of claim 44, wherein the surfactant foam has a density of 0.30 g/cm$^3$ to 0.55 g/cm$^3$.

46. The process of claim 1, wherein the surfactant foam has an average pore size of less than 10 mm.

47. The process of claim 46, wherein the surfactant foam has an average pore size of less than 5 mm.

48. The process of claim 47, wherein the surfactant foam has an average pore size of less than 2 mm.

49. The process of claim 1, wherein the solids comprise one or more builders.

50. The process of claim 49, wherein the builders are selected from the group consisting of carbonates, sulfates, silicates, zeolites, and polymers.

51. The process of claim 1, wherein the solids comprise a spray-dried base powder.

52. The process of claim 51, wherein the spray-dried base powder comprises 10 to 80% by weight of one or more surfactants.

53. The process of claim 52, wherein the spray-dried base powder comprises 15% to 70% by weight of one or more surfactants.

54. The process of claim 53, wherein the spray-dried base powder comprises 20% to 60% by weight of one or more surfactants.

55. The process of claim 1, wherein the surfactant foam is applied to a bed of the solids charged in a mixer in a weight ratio of foam to solids of from 1:100 to 9:1.

56. The process of claim 55, wherein the surfactant foam is applied to a bed of the solids charged in a mixer in a weight ratio of foam to solids of from 1:30 to 2:1.

57. The process of claim 56, wherein surfactant foam is applied to a bed of the solids charged in a mixer in a weight ratio of foam to solids of from 1:20 to 1:1.

58. The process of claim 1, wherein surfactant foam is applied to a bed of the solids charged in a mixer/granulator operating at peripheral tool speeds of from 2 m/s to 7 m/s for a time of 0.5 to 10 minutes.

59. The process of claim 58, wherein the time is 1 to 7 minutes.

60. The process of claim 59, wherein the time is 2 to 5 minutes.

61. The process of claim 1, wherein the surfactant foam is applied to a bed of the solids charged in a mixer/granulator operating at peripheral tool speeds of from 8 m/s to 35 m/s for a time of 0.1 to 30 minutes.

62. The process of claim 1, wherein the surfactant foam is applied to a bed of the solids charged in a mixer/granulator operating at peripheral tool speeds of from 8 m/s to 35 m/s for a time of up to 10 seconds.

63. The process of claim 62, wherein the time is 0.5 to 2 seconds.

64. The process of claim 1, wherein the surfactant foam is applied to an agitated bed of solids in a first, low-speed mixer/granulator in a pregranulation step in which 40% to 100% by weight of the solid and liquid materials forming the surfactant granules are being pregranulated, and in a second, high-speed mixer/granulator the pregranulated materials from the first mixer/granulator and any remaining liquid or solid materials forming the surfactant granules are mixed and formed into the surfactant granules.

65. The process of claim 64, wherein at least a part of the surfactant foam or a second surfactant foam are applied to the solids in the second, high-speed mixer/granulator.

66. The process of claim 1, wherein the surfactant foam is applied to an agitated bed of solids in a first, high-speed mixer/granulator in a pregranulation step in which 40% to 100% by weight of the solid and liquid materials forming the surfactant granules are being pregranulated, and in a second, low-speed mixer/granulator the pregranulated materials from the first mixer/granulator and any remaining liquid or solid materials forming the surfactant granules are mixed and formed into the surfactant granules.

67. The process of claim 66, wherein at least a part of the surfactant foam or a second surfactant foam are applied to the solids in the second, low-speed mixer/granulator.

68. The process of claim 64, conducted batchwise or continuously.

69. The process of claim 66, conducted batchwise or continuously.

70. The process of claim 64, wherein the high-speed mixer has a mixing means and a size reduction means, the mixing means having a shaft operating at 50 to 150 r.p.m. and the size reduction means having a shaft operating at 500 to 5000 r.p.m.

71. The process of claim 70, wherein the high-speed mixer has a mixing means and a size reduction means, the mixing means having a shaft operating at 60 to 80 r.p.m. and the size reduction means having a shaft operating at 1000 to 3000 r.p.m.

72. The process of claim 66, wherein the high-speed mixer has a mixing means and a size reduction means, the mixing means having a shaft operating at 50 to 150 r.p.m. and the size reduction means having a shaft operating at 500 to 5000 r.p.m.

73. The process of claim 72, wherein the high-speed mixer has a mixing means and a size reduction means, the mixing means having a shaft operating at 60 to 80 r.p.m. and the size reduction means having a shaft operating at 1000 to 3000 r.p.m.

74. The process of claim 1, wherein the surfactant granules have a surfactant content of more than 10% by weight and a bulk density of more than 600 g/l.

75. The process of claim 74, wherein the surfactant granules have a surfactant content of more than 15% by weight and a bulk density of more than 700 g/l.

76. The process of claim 75, wherein the surfactant granules have a surfactant content of more than 20% by weight and a bulk density of more than 800 g/l.

77. The process of claim 1, wherein the surfactant granules have a size distribution in which at least 50% by weight of the granules have a size of 400 $\mu$m to 1600 $\mu$m.

78. The process of claim 77, wherein the surfactant granules have a size distribution in which at least 60% by weight of the granules have a size of 400 $\mu$m to 1600 $\mu$m.

79. The process of claim 78, wherein the surfactant granules have a size distribution in which at least 70% by weight of the granules have a size of 400 $\mu$m to 1600 $\mu$m.

80. The process of claim 1, wherein the surfactant granules have residual free water contents of 2 to 15% by weight.

81. The process of claim 80, wherein the surfactant granules have residual free water contents of 4 to 10% by weight.

82. A method of preparing surfactant granules by granulating solids with a granulating fluid, wherein the fluid is a surfactant foam consisting of gas and liquid, the liquid comprising a surfactant or surfactants, wherein the foam has an average pore size of less than 10 mm and a surfactant content of 50% to 99% by weight.

* * * * *

UNITED STATES PATENT AND TRADEMARK OFFICE

CERTIFICATE OF CORRECTION

PATENT NO. : 6,683,042 B1
DATED : January 27, 2004
INVENTOR(S) : Larson et al.

It is certified that error appears in the above-identified patent and that said Letters Patent is hereby corrected as shown below:

Column 19,
Line 49, insert -- 3 -- after the word "claim".

Signed and Sealed this

Twenty-ninth Day of June, 2004

JON W. DUDAS
*Acting Director of the United States Patent and Trademark Office*